US006939131B2

(12) United States Patent
Maumus et al.

(10) Patent No.: US 6,939,131 B2
(45) Date of Patent: Sep. 6, 2005

(54) SUPPORT FOR A PART TO BE SUBJECTED TO HEAT TREATMENT IN AN OVEN, AND A METHOD OF HEAT TREATING A METAL PART

(75) Inventors: Jean-Pierre Maumus, St Medart en Jalles (FR); Serge Chateigner, Le Barp (FR)

(73) Assignee: Snecma Propulsion Solide, Le Haillan Cedex (FR)

( * ) Notice: Subject to any disclaimer, the term of this patent is extended or adjusted under 35 U.S.C. 154(b) by 84 days.

(21) Appl. No.: 10/451,828

(22) PCT Filed: Dec. 26, 2001

(86) PCT No.: PCT/FR01/04197

§ 371 (c)(1),
(2), (4) Date: Jun. 25, 2003

(87) PCT Pub. No.: WO02/053997

PCT Pub. Date: Jul. 11, 2002

(65) Prior Publication Data

US 2005/0100852 A1 May 12, 2005

(30) Foreign Application Priority Data

Dec. 28, 2000 (FR) ..... 00 17168

(51) Int. Cl.[7] ..... F27D 5/00

(52) U.S. Cl. ..... 432/253; 432/258; 432/259; 432/260; 248/346.01; 269/296; 269/903

(58) Field of Search ..... 432/252, 253, 432/258, 259, 260, 261; 248/346.01, 346.03; 269/296, 903

(56) References Cited

U.S. PATENT DOCUMENTS

| | | | |
|---|---|---|---|
| 1,941,941 | A | 1/1934 | Irwin |
| 2,273,475 | A | 2/1942 | Schreiber |
| 3,266,116 | A | 8/1966 | Rush |
| 4,715,812 | A | 12/1987 | von Matuschka et al. |
| 5,576,058 | A | 11/1996 | Norrgrann et al. |
| 5,603,875 | A | 2/1997 | Giller et al. |
| 5,752,821 | A | 5/1998 | Jo |

FOREIGN PATENT DOCUMENTS

| | | | |
|---|---|---|---|
| FR | 2 772 467 | A | 6/1999 |
| GB | 486 330 | A | 6/1938 |
| GB | 678 668 | A | 9/1952 |

*Primary Examiner*—Jiping Lu
(74) *Attorney, Agent, or Firm*—Weingarten, Schurgin, Gagnebin & Lebovici LLP

(57) ABSTRACT

A support slug (2) used for the heat treatment of a part (3), particularly for the hardening of a steel part, comprises a guide element (221) that is used to guide the part (3) towards a supporting surface (230) of the support slug (2) when said part is being positioned on the support slug. A ceramic element (23) including the supporting surface (230) is embedded in the metal body (20) of the support slug.

40 Claims, 6 Drawing Sheets

SUPPORT FOR A PART TO BE SUBJECTED TO HEAT TREATMENT IN AN OVEN, AND A METHOD OF HEAT TREATING A METAL PART

FIELD OF THE INVENTION AND DESCRIPTION OF THE PRIOR ART

The present invention relates to a support for supporting a part, in particular a metal part, while heat treatment is being applied to said part in an oven.

In a particular but non-exclusive application of the invention, the heat treatment is low pressure cementation treatment of a steel part, e.g. while using gas, oil, etc.

French patent application FR-A-2 772 467 discloses a device for supporting parts for heat treatment in an oven, the device comprising plates each having groups of metal pegs mounted thereon. Each group of metal pegs serves as a support for a part to be treated, which part is in the form of a gearwheel. The plates are designed to be capable of being superposed vertically.

In practice, the parts are loaded onto the plates and the plates are superposed by means of a robot. In order to position a given part on its group of support pegs, the robot presents the part above the group of pegs, and then releases it.

Since the precision of the robot is limited, it sometimes happens that the part does not fall correctly on its group of support pegs, and after being dropped ends up being wrongly positioned thereon. In such a situation, if the robot is fitted with a system for detecting the presence of a part, it will detect an anomaly and stop. Manual intervention is then required to position the part correctly and to restart the robot. If the robot is not fitted with a system for detecting the presence of a part, it will continue to load parts onto the plate, but superposition of the following plate will be impeded by the presence of the wrongly-positioned part. In some cases, when the following plate is put into place, it may even break under the effect of the opposing forces exerted by the robot and the wrongly-positioned part.

In addition to those problems relating to loading parts, it has also been found that when the parts to be treated are metal parts, they tend to stick to their support pegs during the heat treatment, which makes them difficult to unload once the heat treatment has terminated.

In order to avoid that sticking phenomenon, the above-mentioned French patent application FR-A-2 772 467 proposes coating the support pegs in copper. That solution is effective in the short term, but it ceases to produce the desired effect after repeated use of the support pegs, so the pegs need to be replaced frequently.

OBJECTS AND SUMMARY OF THE INVENTION

The present invention seeks firstly to provide a support that makes it possible to improve the efficiency with which a part for heat treatment is loaded.

To this end, the invention provides a support for supporting, at least in part, a part during heat treatment of said part, the support being characterized in that it includes a guide element for guiding the part towards a support surface or support surface portion of the support while the part is being put into place on the support.

The term "at least in part" means that the support of the invention may be used for supporting the part in full, or in a variant, it may be used for supporting only a portion of said part. In which case, the support force is shared between the support of the invention and one or more other supports, preferably identical to the support of the invention.

The guide element of the support of the invention makes it easier to put the part for treatment into place, particularly when said positioning is performed robotically, and it serves to compensate for possible inaccuracy of the robot.

The guide element may consist in an elongate element extending from a base of the support substantially perpendicularly to said base and having an end portion remote from the base that is bullet-shaped. More particularly, the guide element may comprise a rod terminated by a head, the head constituting said bullet-shaped end portion. Advantageously, the rod is of diameter smaller than that of the head. Preferably, the end of the guide element remote from the base is rounded.

The present invention also seeks to provide a support which makes it possible, in practical and effective manner, to continue in the long term unloading metal parts that have been subjected to heat treatment.

For this purpose, the support of the invention comprises a metal body, of which the guide element may form a part, and a ceramic element set in the metal body and defining said support surface.

Because of the use of a ceramic material to form the support surface on which the metal part for treatment rests directly, heat treatment can be performed on the part, e.g. treatment of the cementation type (in particular when the part is made of steel), without that causing the support surface and the part to stick together. Once the treatment is over, the part is thus easier to unload.

Furthermore, the fact that the ceramic element is set in a metal body makes it possible to increase the ability of the ceramic to withstand impacts. It is thus possible to begin by loading the part for treatment by placing said part over the support and then releasing it, this being done by robot, with small risk of the ceramic breaking.

Furthermore, even if the ceramic does break, that will not affect the entire support and only the ceramic element will need to be replaced. In this respect the ceramic element may be mounted in the metal body in such a manner as to be easily replaced. For example, the ceramic element may be crimped in the metal body, or it may merely be placed in a recess in the metal body without being fixed thereto, or it may be placed in a recess in the metal body and retained in said recess by one or more bonding or brazing points formed on or close to the top edge of the recess.

Advantageously, the ceramic used in the present invention is mullite. This material presents good mechanical strength.

Preferably, the ceramic element is set in the metal body with clearance allowing the ceramic element and the metal body to expand freely.

In an embodiment of the invention, the ceramic element is set in a base of the metal body constituting the above-mentioned base of the support. The ceramic element may thus consist in an annular part having an axis of symmetry in common with the guide element.

The support surface is preferably inclined, or includes an inclined portion, so as to prevent lateral movement of the part when it rests, at least in part, flat on the support. This ensures that the part is properly held on the support under the effect of the force of gravity to which said part is subjected while avoiding any contact between the part and the guide element.

The support surface is preferably shaped so as to provide contact, at one or a plurality only of discrete points, with an annular part when such an annular part rests, at least in part, flat on the support.

Such contact via one or a plurality only of discrete points enables the part to be held practically in suspension during heat treatment and consequently ensures that the largest possible fraction of the surface of the part is subjected to said treatment.

Thus, by way of example, the support surface may be frustoconical in shape, or may be in the form of a portion of the surface of a sphere.

In another embodiment of the invention, the ceramic element is set in the end portion of the guide element.

In general, the support of the invention may be in the form of a pawn-shaped peg.

The support of the invention typically further includes means for fixing it to a support plate.

Such fixing means may comprise a projection from the support for insertion into a corresponding through hole in the support plate from a first end of said hole, and including a thin flared portion suitable for co-operating with a chamfer provided at a second end of the through hole, opposite from the first end.

The present invention also provides support equipment comprising a support plate and at least one support as defined above mounted on the support plate.

The support plate is preferably made of a thermostructural composite material such as a carbon-carbon composite material. The or each support, and more particularly the metal body thereof, is advantageously mounted on the support plate by crimping and with clearance.

In order to avoid possible problems of the support(s) becoming separated from the support plate due to thermal expansion differences between the support body(ies) and the support plate during treatment of the part, the point of intersection between an axis of symmetry of the or each support and the plane of a surface of the support plate receiving the or each support substantially coincides with the apex of the cone defined by an outside surface of the thin flared portion.

In a particular embodiment, the support equipment of the invention has at least one group of three supports disposed in a triangle.

The invention also provides a method of heat treating a metal part which acts in the long term to facilitate unloading of the part after the heat treatment has been performed.

For this purpose, a method is provided on applying heat treatment to a metal part, the method being characterized in that, in order to support said part, use is made of at least one support having a ceramic surface, preferably made of mullite, on which said part rests, at least in part.

The metal part is preferably in contact with the ceramic surface via one or a plurality only of discrete points.

In a particular application of the invention, the heat treatment consists in an operation of cementation on a part made of steel.

It has been found that when such a cementation operation is implemented with a support that is made of metal only as in the prior art, a carbon microdiffusion phenomenon occurs at the support, which tends to lower its melting point and which consequently leads to the part becoming stuck to the support.

The use in accordance with the invention of ceramic to constitute the support surface that is to come into contact with the part for treatment remedies this sticking problem.

DESCRIPTION OF SOME EMBODIMENTS OF THE INVENTION

A plurality of embodiments of the invention are described below in detail.

Figure 1:
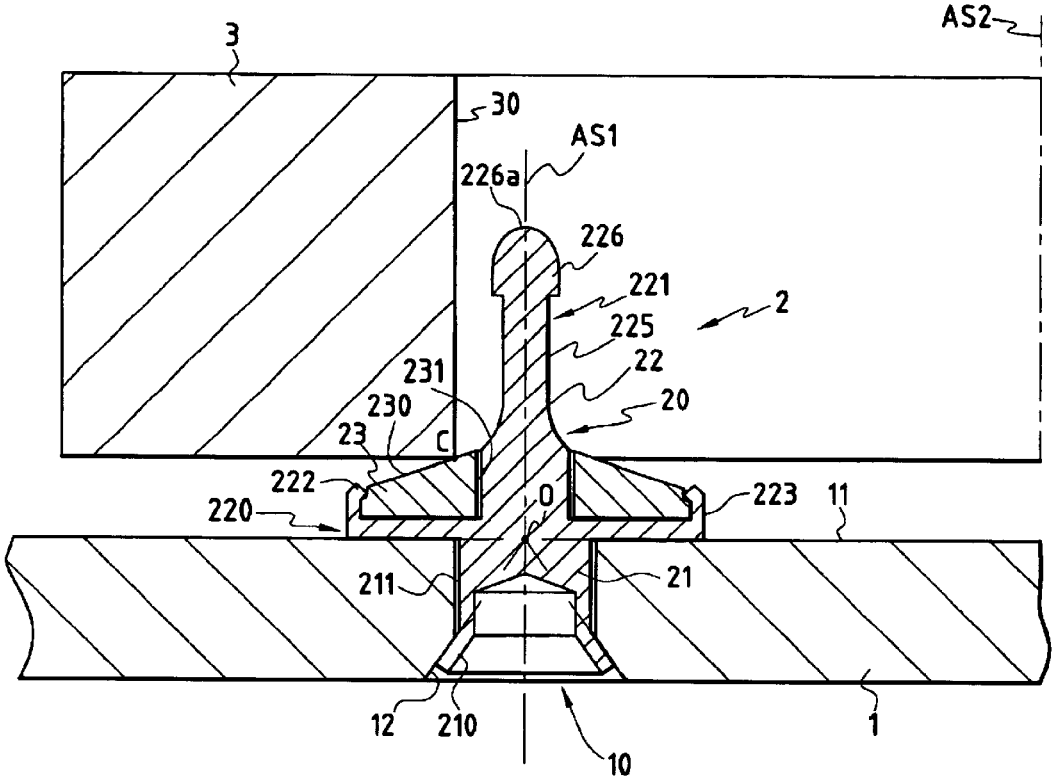
FIG. 1 is a half-view in section on plane I of FIG. 2 showing a portion of support equipment constituting a first embodiment of the invention, with an annular part resting thereon.
Figure 2:
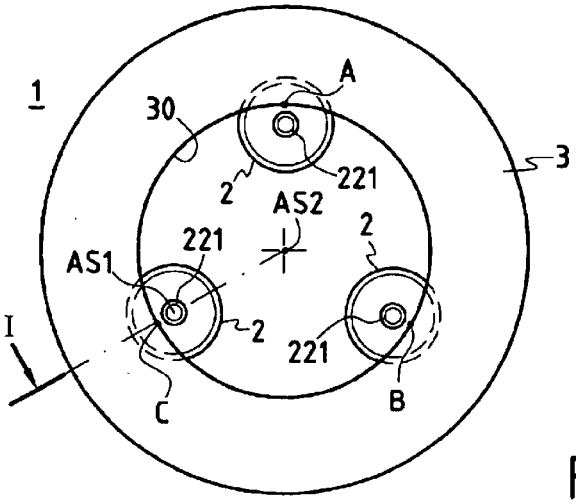
FIG. 2 shows the portion of support equipment and the annular part of FIG. 1, as seen from above.

With reference to FIGS. 1 and 2, support equipment constituting a first embodiment of the invention for use in heat treatment of a metal part, such as cementation of a steel part, comprises a support plate 1 and supports in the form of pawn-shaped pegs 2 mounted on the support plate 1. As shown in FIG. 2, the pegs 2 are grouped together in threes. In each group of pegs (only one group is shown in FIG. 2), the pegs 2 are disposed in a triangle, preferably an equilateral triangle. Each support plate 1 is preferably made of a thermostructural composite material, such as a carbon-carbon composite material. Nevertheless, in a variant it could be made of metal.

Each peg 2 comprises a metal body 20 constituted by a projecting bottom portion 21 received in a corresponding cylindrical through hole 10 in the support plate 1, and a top portion 22 extending above the top surface (designated by reference 11) of the support plate 1, and extending perpendicularly to said surface. The body 20 is preferably monolithic.

Each peg 2 is fixed to the support plate 1 by crimping. For this purpose, the bottom end of the bottom portion 21 has a thin flared portion 210 co-operating with a chamfer 12 formed in the bottom edge of the through hole 10.

In practice, the support equipment of the invention is assembled by presenting each peg 2 over the corresponding through hole 10, then inserting the bottom portion 21 into the hole 10 in a downward direction until the flared portion 210 co-operates with the chamfer 12.

The top portion 22 of each peg 2 includes a base 220 in the form of a skirt which rests on the top surface 11 of the support plate 1, and a central and elongate guide element 221 extending perpendicularly to the support plate 1 and to the base 220 from the top of the base 220 on an axis of symmetry AS1 of the peg 2.

Figure 3:
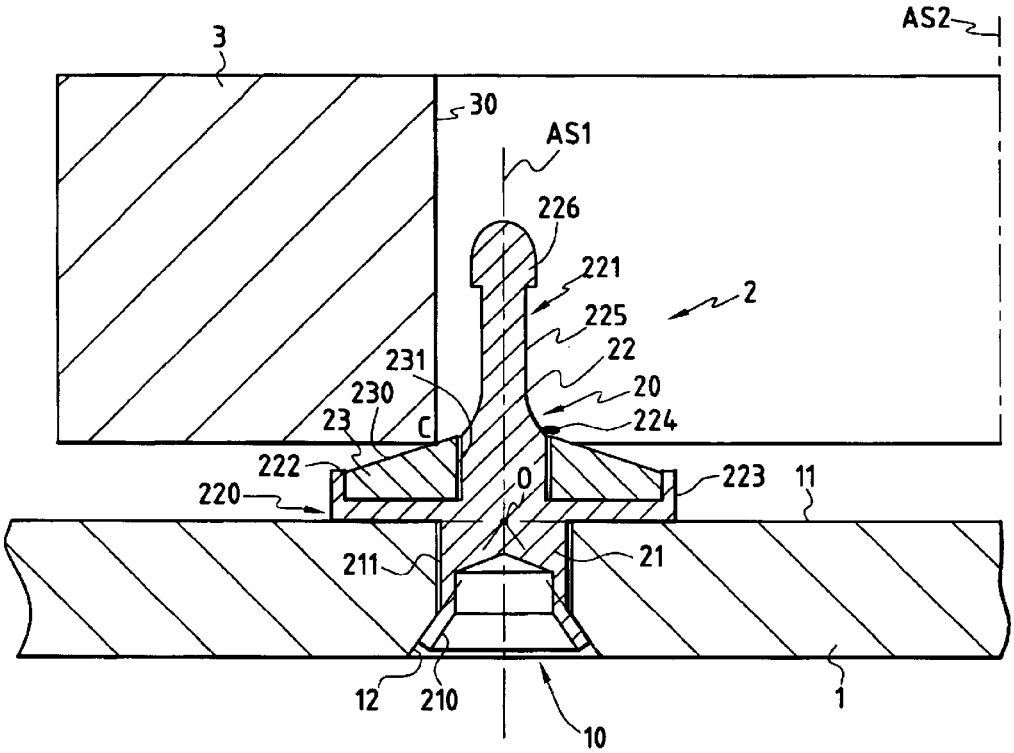
FIG. 3 is a view of the same type as FIG. 1, showing a variant of the first embodiment of the invention.

The bottom portion of the base 220 is cylindrical, and its top portion tapers. It also includes a recess in which a ceramic element 23 is received, the ceramic element being in the form of an annular pellet having a frustoconical top surface 230. More specifically, the ceramic pellet 23 is crimped to the base 220, by co-operation between a chamfer formed in the top outside edge of the pellet 23 and a projection 222 on an annular edge 223 of the base 220. Nevertheless, the ceramic pellet 23 could be mounted differently in the recess of the base 220. For example it could merely be placed in the recess, without being crimped or fixed in any other way, so as to make it easier to replace in the event of it being broken. It can also be placed in the recess and held therein merely by one or more bonding or brazing points 224 formed on or close to the top edge of the recess, as shown in FIG. 3.

The frustoconical top surface 230 of the ceramic pellet 23 is flush with the top face of the base 220, so that it can act as a support surface, and it is arranged so that the apex (not shown) of the cone defined by said frustoconical surface points towards the top end of the peg 2 along the axis AS1.

The guide element 221 comprises a rod 225 terminated at its top end remote from the base 220 by a head 226. The shape of the head 226 is selected so as to provide effective guidance while a part for treatment is being positioned on the peg 2. Typically, the head 226 is in the form of a shell or bullet, preferably in the form of a bullet as shown in the figures. The top end 226*a* of the head 226 is preferably rounded rather than being pointed. Advantageously, the diameter of the rod 225 is less than the diameter of the head 226.

While the support equipment of the invention is in use in a heat treatment oven, such as a cementation reactor, differential expansion takes place between the respective bodies 20 of the pegs 2 and the support plate 1 when these elements are not made of the same material. This can result in the connection between a peg 2 and the support plate 1 separating.

In order to remedy this problem, each peg 2 is arranged relative to the plate 1 in such a manner that the point of intersection (identified by reference 0 in FIG. 1) between the axis of symmetry AS1 of the peg 2 and the geometrical plane defined by the top surface 11 of the plate 1 substantially coincides with the apex of the cone defined by the outside surface (in contact with the chamfer 12) of the thin flared portion 210. In addition, a small amount of clearance 211 may be provided between the outside face of the projecting bottom portion 21 of each peg 2 and the inside face of the corresponding hold 10. In comparable manner, differential expansion between the ceramic pellet 23 and the metal body 20 of each peg 2 can be absorbed by a small amount of lateral clearance 231 between the inside and/or outside faces of the pellet 23 and the corresponding wall(s) of the annular recess in the body 20.

With reference to FIG. 2, an annular metal part 3 for heat treatment, such as gearwheel, is laid flat on a group of three pegs 2 so as to rest on the ceramic frustoconical surfaces 230 of the pegs 2. The term "laid flat" is used to mean that the axis of symmetry (designated by reference AS2) of the annular part 3 is perpendicular to the support plate 1, or in other words parallel to the axis of symmetry AS1 of each peg 2.

Because of the respective annular and frustoconical shapes of the part 3 and of the ceramic support surface 230 of each peg 2, and because of the positions of the pegs 2 relative to the part 3, contact between the parts 3 and each of the ceramic support surfaces 230 is point contact. The part 3 is thus supported by the support equipment 1, 2 of the invention at three discrete points A, B, and C.

As shown in FIG. 2, the guide elements 221 lie inside the inside surface 30 of the part 3 and are separate from said inside surface, i.e. at no point do they make contact with the part 3. Because of the way the support surfaces 230 are inclined, the part 3 is securely held by the peg 2 under the effect of gravity. In position, the part 3 cannot move sideways to come into contact with the guide elements 221.

The part 3 is preferably placed on the pegs 2 by means of a robot, which places the part 3 above the pegs 2 and then releases it so that it falls onto the pegs. As it falls towards the ceramic support surfaces 230, the part 3 is guided by the respective bullet-shaped heads 226 of the guide elements 221. Because of the difference in diameter between the rods 225 and the heads 226 (the rods 225 being narrower than the heads 226), after the part 3 has been guided by the heads 226 it is no longer in contact with the guide elements 221. This makes it easier to drop the part 3 onto the support surfaces 230.

Because the ceramic pellet 23 of each peg 2 is set in the metal body 20, i.e. because it is mounted in a recess in the body 20, the ability of the pellet 23 to withstand impacts is increased. As a result, the risk of the ceramic breaking when the part 3 comes into contact with the pegs 2 is reduced. Preferably, in order to further increase the strength of the element 23, the element is made of mullite.

After the metal part 3 has been put into place on the pegs 2, the assembly constituted by the support equipment 1, 2 and the part 3 is placed in an oven, such as a cementation reactor (not shown), in which the part 3 is subjected to heat treatment. At the end of this treatment, the part 3 can be removed without difficulty from the support equipment 1, 2 since the part 3 and the pegs 2 are not stuck together because the support surfaces 230 that make direct contact with the metal part 3 are made of the ceramic material.

Figure 4:
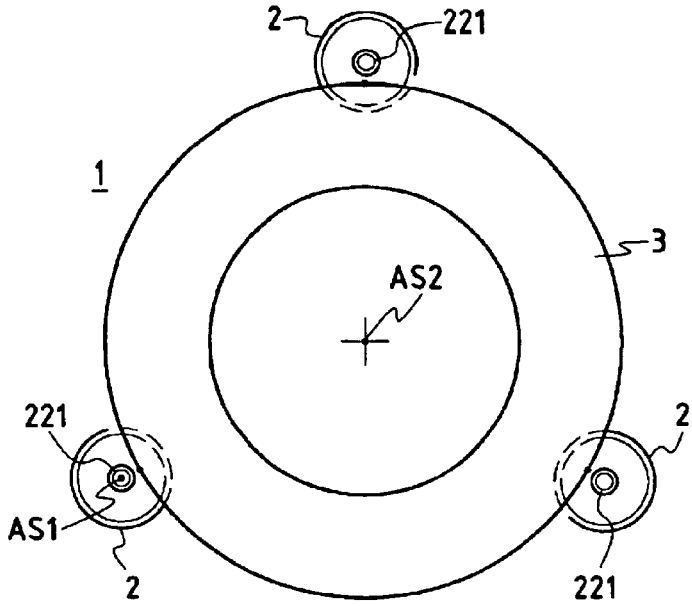
FIG. 4 is a plan view showing another way of positioning an annular part on the support equipment of the invention.
Figure 5:
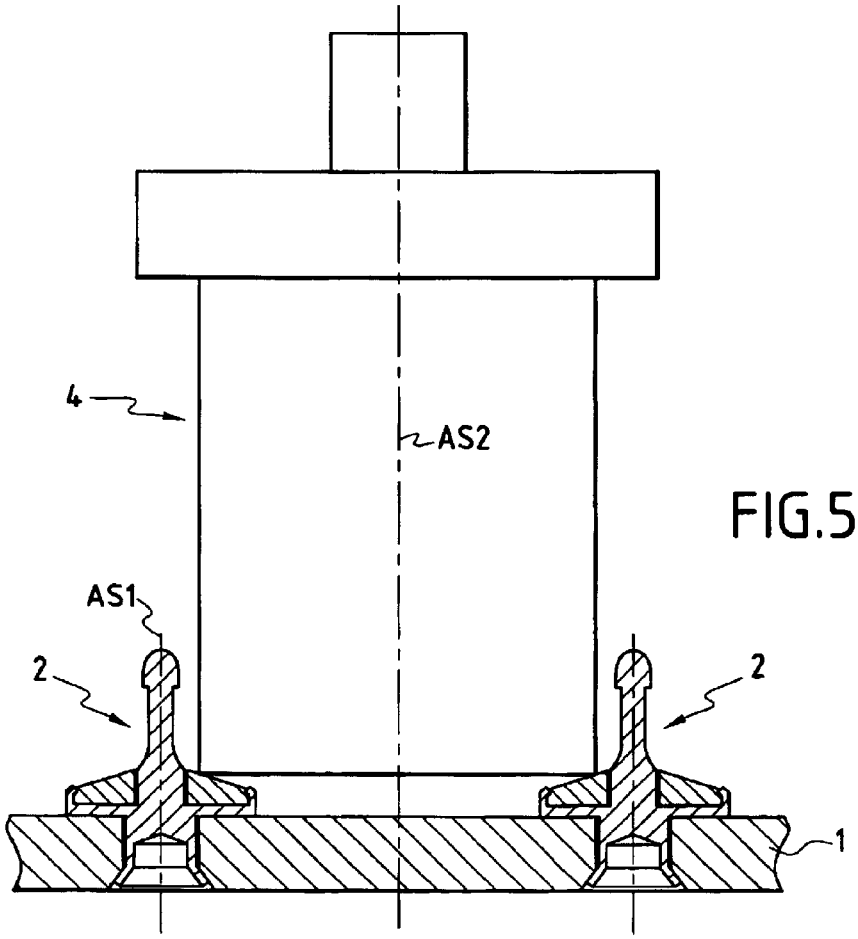
FIG. 5 is a section view showing how an elongate vertical part in the form of a piston can be positioned on the support equipment of the invention.

In the arrangement shown in FIGS. 1 and 2, the annular part 3 and the pegs 2 are disposed in such a manner that the guide elements 21 lie in the central empty space of the part 3 defined by the inner annular surface thereof. Nevertheless, other configurations are possible. For example, with reference to FIG. 4, the pegs 2 could be arranged so that the guide elements 221 lie outside the outer annular face of the part 3. Under such circumstances, the part 3 need not necessarily be annular, but could equally well be cylindrical. Also by way of example, FIG. 5 shows support pegs 2 of the invention supporting an elongate vertical part 4 in the form of a piston. Although only two pegs 2 are shown in FIG. 5, at least three pegs are used in order to ensure that the part 4 is properly supported.

Figure 6:
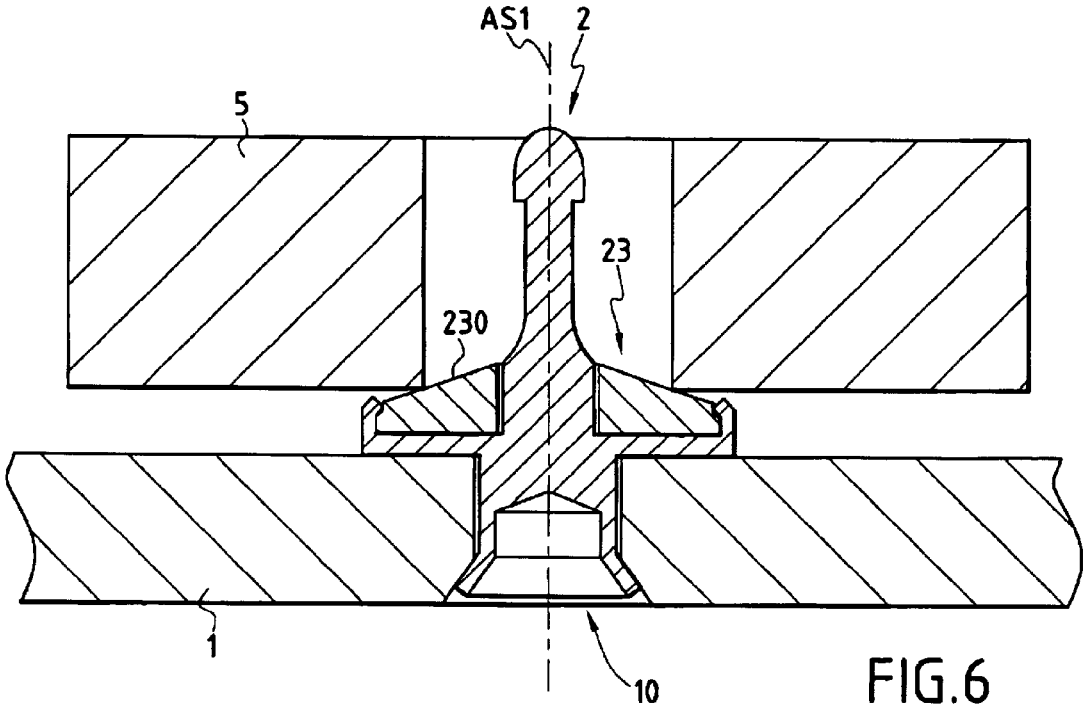
FIG. 6 is a section view showing another way of positioning an annular part on the support equipment of the invention.

FIG. 6 shows another type of configuration in which each peg 2 supports an annular metal part 5 completely, and not in part only as in the arrangements of FIGS. 1 to 5. The axis of symmetry of the annular part 5 thus coincides with the axis AS1 of the peg 2.

Figure 7:
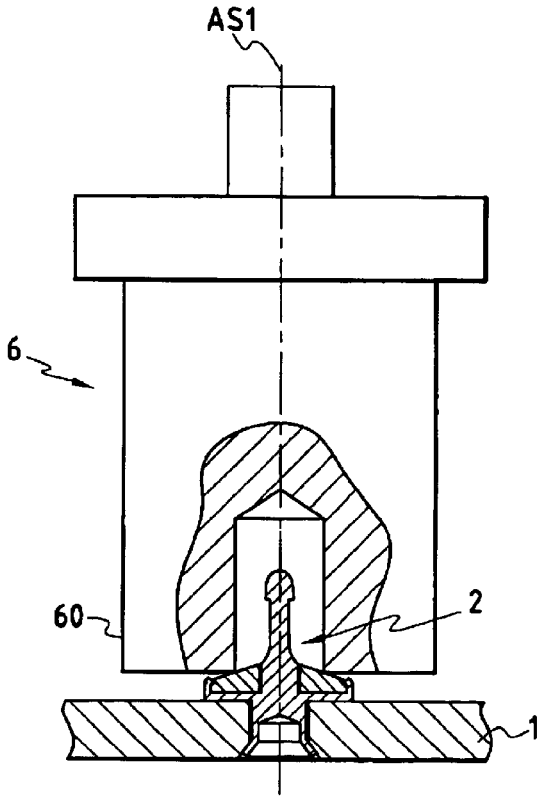
FIG. 7 is a section view showing another way of positioning an elongate vertical part in the form of a piston on the support equipment of the invention.

FIG. 7 shows a peg 2 of the invention completely supporting a part 6 in the form of a piston and having an annular bottom portion 60.

When the pegs 2 are for use as shown in FIGS. 6 and 7, it can be envisaged to shape their ceramic support surfaces 230 in such a manner as to ensure that contact between each peg 2 and the corresponding part 5 or 6 takes place at discrete points only. For example, each ceramic support surface 230 may have small projections at locations that are to define contact points with the parts 5 or 6.

In general, the person skilled in the art will understand that the invention is not limited to any one particular shape for the ceramic support surfaces 230 and that these surfaces can be shaped in numerous ways so as to ensure that each of them makes contact at one or a plurality only of discrete points with an annular part when the annular part is laid flat, fully or in part only, on the corresponding peg.

Figure 8:
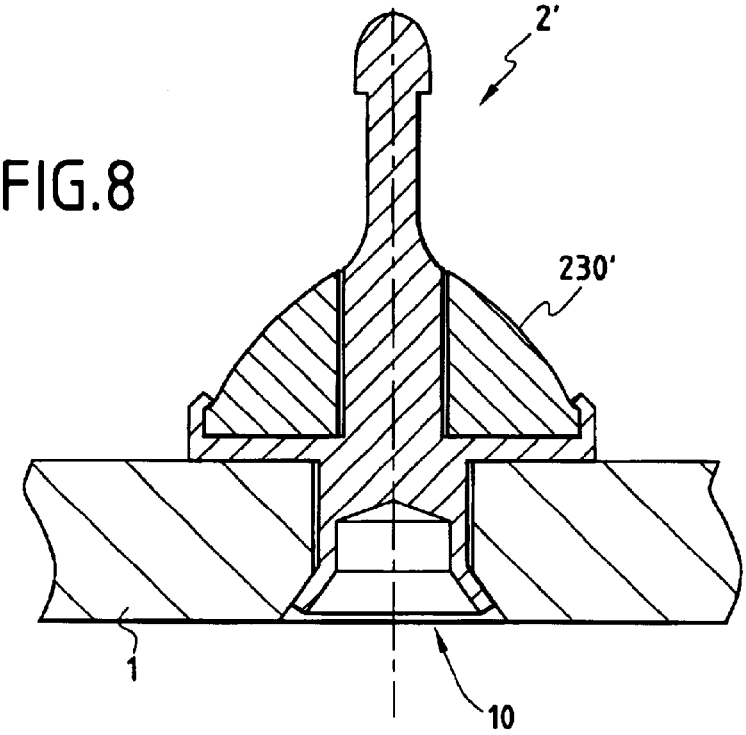
FIG. 8 is a section view of a portion of support equipment in a second embodiment of the invention.

By way of example, FIG. 8 shows a second embodiment of the invention in which each peg 2' (only one peg 2' is shown in FIG. 8) presents a ceramic support surface 230' forming part of a spherical surface.

In all of the examples described above, the parts to be treated rest on ceramic surfaces situated on the bases of the pegs 2, 2'.

Figure 9:
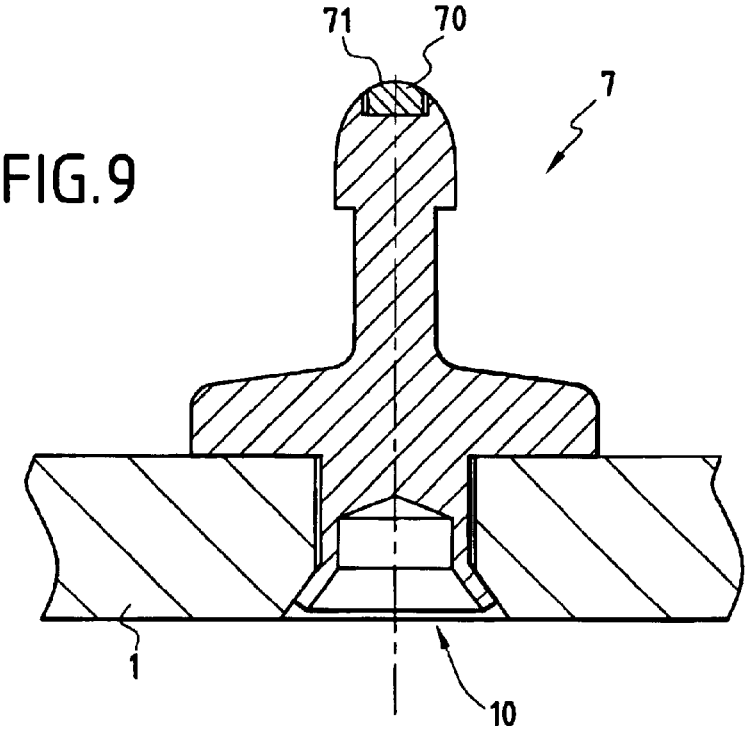
FIGS. 9 and 10 are section views of a portion of support equipment in a third embodiment of the invention.
Figure 10:
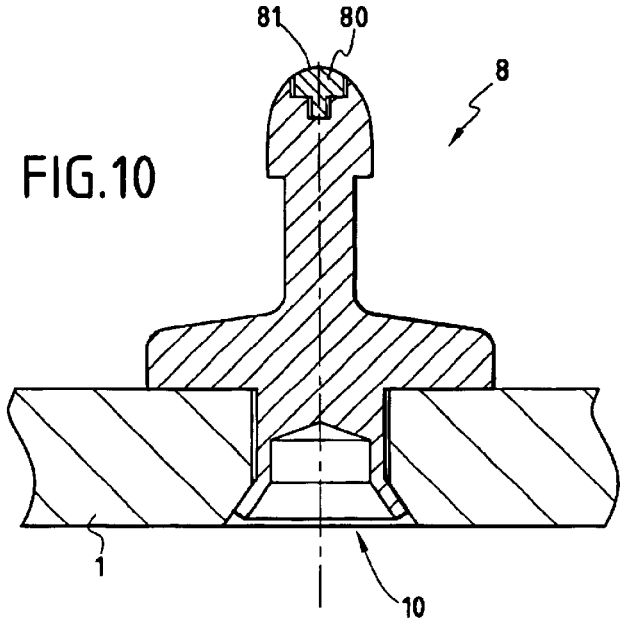

FIGS. 9 and 10 show respective support pegs 7 and 8 constituting a third embodiment of the invention. The pegs 7 and 8 differ from the pegs 2 and 2' essentially in that each of them the ceramic element is set in the head of the guide element, not in the base of the metal body (cf. references 70 and 80). The ceramic element 70 (or 80) presents a rounded support surface 71 (or 81) on which a part comes to rest. Advantageously, the ceramic elements 70 and 80 are merely placed without being fixed in a corresponding recess in the head of the guide elements so as to make them easy to replace if they are broken. In a variant, they may nevertheless be crimped in the recesses or held in position by one or more brazing points in a manner comparable to the example of FIG. 3.

Figure 11:
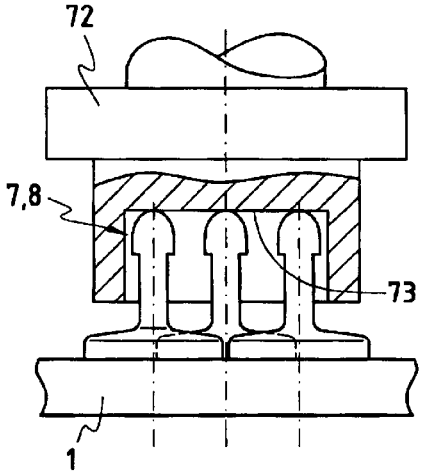
FIG. 11 is a fragmentary section view showing the support equipment of the third embodiment of the invention supporting a part.

By way of example, the pegs 7 and 8 may be used as shown in FIG. 11. In the arrangement of FIG. 11, a group of three support pegs of the same type as the pegs 7 or 8 supports a metal part 72 via three contact points, the metal part having an annular bottom portion and a solid cylindrical top portion. Contact between the part 72 and the pegs 7 or 8 takes place via a metal bearing surface 73 of the part 72 and the ceramic surface 71 or 81 of each peg. As in the preceding embodiments, positioning the part 72 on the pegs 7 or 8 is made easier by the guide elements.

Figure 12:
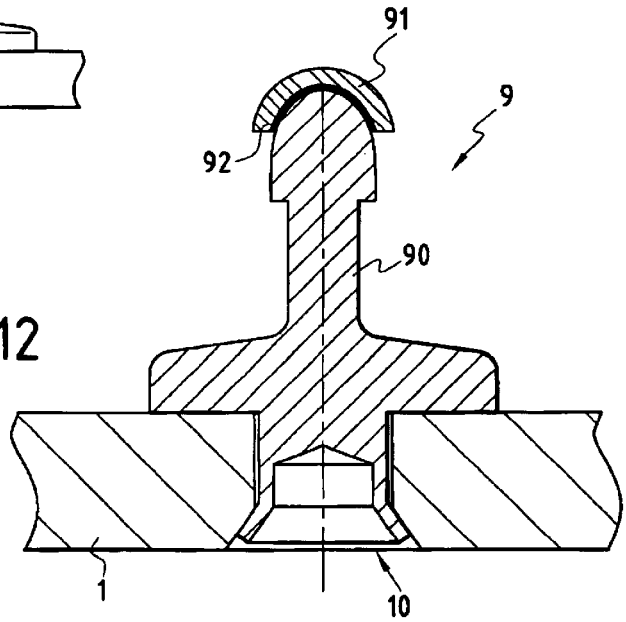
FIG. 12 is a section view of a portion of support equipment in a fourth embodiment of the invention.

FIG. 12 shows a support peg 9 constituting a fourth embodiment of the invention. The peg 9 is constituted by a metal body 90 and a ceramic covering layer 91 covering the head of a guide element of the metal body 90 and fixed to said head, e.g. by adhesive or brazing, as identified by reference 92. Unlike the pegs described above, the ceramic element 91 is not set in the metal body. Nevertheless, the peg 9 may also be used for supporting a metal part during heat treatment such as a steel part being subjected to cementation, e.g. in the manner shown in FIG. 11 for the pegs 7 and 8.

What is claimed is:

1. A support for supporting, at least in part, a part during heat treatment of said part, the support comprising:

a metal body comprising a guide element and a base, the guide element comprising an elongated element extending from the base substantially perpendicularly to the base and an end portion on the elongated element remote from the base, wherein the end portion is bullet-shaped; and a ceramic element set in the metal body, the ceramic element including a support surface or support surface portion;

wherein the guide element is configured to guide a part toward the support surface or support surface portion while the part is being put into place on the support.

2. A support according to claim 1, characterized in that the guide element comprises a rod terminated by a head, the head constituting said bullet-shaped end portion.

3. A support according to claim 2, characterized in that the rod is of diameter smaller than that of the head.

4. A support according to claim 3, characterized in that the end of the guide element remote from the base is rounded.

5. A support according to claim 3, characterized in that the end of the guide element remote from the base is rounded;

said ceramic element is comprised of mullite;

the ceramic element is one of crimped in the metal body and placed in a recess of the metal body and is retained in said recess by one or more bonding or brazing points formed on or close to a top edge of the recess, and the ceramic element is merely placed in a recess of the metal body;

the ceramic element is set in the metal body with clearance allowing the ceramic element and the metal body to expand freely;

the ceramic element is set in said base;

the ceramic element comprises an annular part having an axis of symmetry (AS1) in common with the guide element;

the support surface or support surface portion is shaped to provide contact at one or a plurality only of discrete points with an annular part when such an annular part rests, at least in part, flat on the support;

the support surface or support surface portion is inclined, or includes an inclined portion, so as to prevent lateral movement of the part when it rests, at least in part, flat on the support; and the support surface or support surface portion is frusto-conical in shape or is in the form of part of a spherical surface.

6. A support according to claim 5, characterized in that:

the metal body comprises a generally pawn-shaped peg;

the support further comprises means for fixing to a support plate;

the fixing means comprise a projection from the support, for insertion into a corresponding through hole in the support plate from a first end of said hole, and having a thin flared portion suitable for co-operating with a chamfer provided at a second end of the through hole, opposite from the first end.

7. A support according to claim 2, characterized in that the end of the guide element remote from the base is rounded.

8. A support according to claim 1, characterized in that the end of the guide element remote from the base is rounded.

9. A support according to claim 1, characterized in that the ceramic element is comprised of mullite.

10. A support according to claim 1, characterized in that the ceramic element is crimped in the metal body.

11. A support according to claim 1, characterized in that the ceramic element is placed in a recess of the metal body and is retained in said recess by one or more bonding or brazing points formed on or close to a top edge of the recess.

12. A support according to claim 1, characterized in that the ceramic example is merely placed in a recess of the metal body.

13. A support according to claim 1, characterized in that the ceramic element is set in the metal body with clearance allowing the ceramic element and the metal body to expand freely.

14. A support according to claim 1, characterized in that the ceramic element is set in said base.

15. A support according to claim 14, characterized in that the ceramic element comprises an annular part having an axis of symmetry (AS1) in common with the guide element.

16. A support according to claim 14, characterized in that the support surface or support surface portion is shaped to provide contact at one or a plurality only of discrete points with an annular part when such an annular part rests, at least in part, flat on the support.

17. A support according to claim 14, characterized in that the support surface or support surface portion is inclined, or includes an inclined portion, so as to prevent lateral movement of the part when it rests, at least in part, flat on the support.

18. A support according to claim 14, characterized in that the support surface or support surface portion is frustoconical in shape.

19. A support according to claim 14, characterized in that the support surface or support surface portion is in the form of part of a spherical surface.

20. A support according to claim 1, characterized in that the ceramic element is set in the end portion of the guide element.

21. A support according to claim 1, characterized in that the metal body comprises a generally pawn-shaped peg.

22. A support according to claim 1, further comprising means for fixing to a support plate.

23. A support according to claim 22, characterized in that the fixing means comprise a projection from the support, for insertion into a corresponding through hole in the support plate from a first end of said hole, and having a thin flared portion suitable for co-operating with a chamfer provided at a second end of the through hole, opposite from the first end.

24. Support equipment comprising a support plate and at least one support as defined in claim 1, mounted on the support plate.

25. Support equipment according to claim 24, characterized in that the support plate is made of a thermostructural composite material.

26. Support equipment according to claim 25, characterized in that the or each support is mounted on the support plate by crimping.

27. Support equipment according to claim 26, characterized in that the or each support is mounted on the support plate with clearance.

28. Support equipment according to claim 24, characterized in that the support plate is made of a carbon-carbon composite material.

29. Support equipment according to claim 24, characterized in that the or each support includes a projection terminated by a thin flared portion, and the support plate has at least one through hole receiving the projection of the support or a corresponding support and having a chamfer which co-operates with the thin flared portion to hold the projection in the through hole.

30. Support equipment according to claim 29, characterized in that the point of intersection (O) between an axis of symmetry (AS1) of the or each support and the plane of a surface of the support plate receiving the or each support coincides substantially with the center of the cone defined by an outside surface of the thin flared portion.

31. Support equipment according to claim 24, further comprising at least one group of three supports disposed in a triangle.

32. Support equipment comprising a support plate and at least one support as defined in claim 6, mounted on the support plate, and further the support plate is made of a thermostructural or a carbon-dioxide composite material;

the or each support is mounted on the support plate by crimping;

the or each support is mounted on the support plate with clearance;

the or each support includes a projection terminated by a thin flared portion, and the support plate has at least one through hole receiving the projection of the support or a corresponding support and having a chamfer which co-operates with the thin flared portion to hold the projection in the through hole;

the point of intersection (O) between an axis of symmetry (AS1) of the or each support and the plane of a surface of the support plate receiving the or each support coincides substantially with the center of the cone defined by an outside surface of the thin flared portion; and the support comprises at least one group of three supports disposed in a triangle.

33. The method of use of a support according to claim 1, comprising supporting a metal part with said support during heat treatment of said part.

34. The method of use according to claim 33, characterized in that the metal part is a steel part and the heat treatment step comprises cementation of the steel part.

35. A method of performing heat treatment on a metal part, comprising supporting said part with at least one support as defined in claim 1 during heat treatment of said part.

36. A method according to claim 35, further comprising contacting the metal part with the support surface or support surface portion of the ceramic element of the support at one or a plurality only of discrete points.

37. A method according to claim 35, characterized in that the metal part is a steel part, and the heat treatment step comprises cementation of the steel part.

38. The method of use of a support according to claim 5 comprising supporting a metal part with said support during heat treatment of said part, and wherein the metal part is a steel part and the heat treatment step comprises cementation of the steel part.

39. A method of performing heat treatment on a metal part comprising supporting said part with at least one support as defined in claim 5 during heat treatment of said part, and further comprising contacting the metal part with the support surface or support surface portion of the support at one or a plurality only of discrete points, and wherein the metal part is a steel part, and the heat treatment step comprises cementation of the steel part.

40. A method of performing heat treatment on a metal part comprising supporting said part with at least one support as defined in claim 6 during heat treatment of said part, and further comprising contacting the metal part with the support surface or support surface portion of the support at one or a plurality only of discrete points, and wherein the metal part is a steel part, and the heat treatment step comprises cementation of the steel part.

* * * * *

UNITED STATES PATENT AND TRADEMARK OFFICE

CERTIFICATE OF CORRECTION

PATENT NO. : 6,939,131 B2
APPLICATION NO. : 10/451828
DATED : September 6, 2005
INVENTOR(S) : Jean-Pierre Maumus et al.

It is certified that error appears in the above-identified patent and that said Letters Patent is hereby corrected as shown below:

Column 5, line 47, “reference 0” should read --reference O--; and

Column 8, claim 9, line 49, “in that the” should read --in that said--.

Signed and Sealed this

Seventeenth Day of October, 2006

JON W. DUDAS
*Director of the United States Patent and Trademark Office*